US009267305B1

(12) United States Patent
Reynolds

(10) Patent No.: US 9,267,305 B1
(45) Date of Patent: Feb. 23, 2016

(54) LOUVERED SNOW PLOW

(76) Inventor: Mark A. Reynolds, Interlochen, MI (US)

( * ) Notice: Subject to any disclaimer, the term of this patent is extended or adjusted under 35 U.S.C. 154(b) by 888 days.

(21) Appl. No.: 12/314,000

(22) Filed: Nov. 26, 2008

(51) Int. Cl.
*E01H 5/06* (2006.01)
*E04H 5/06* (2006.01)

(52) U.S. Cl.
CPC ..... *E04H 5/06* (2013.01)

(58) Field of Classification Search
USPC ..... 37/266, 273, 275
See application file for complete search history.

(56) References Cited

U.S. PATENT DOCUMENTS

| | | | | | |
|---|---|---|---|---|---|
| 1,736,352 | A | * | 11/1929 | Mahoney et al. | 171/136 |
| 1,926,011 | A | * | 9/1933 | Soule | 37/275 |
| 2,085,996 | A | | 7/1937 | Phillips | |
| 2,160,972 | A | * | 6/1939 | Litchy | 37/275 |
| 2,160,973 | A | * | 6/1939 | Litchy | 37/273 |
| 2,841,894 | A | * | 7/1958 | Valois | 37/236 |
| 3,202,226 | A | * | 8/1965 | Carson | 172/701.3 |
| 3,432,947 | A | * | 3/1969 | Peitl | 37/281 |
| 4,019,587 | A | * | 4/1977 | Meisel, Jr. | 172/815 |
| 4,024,922 | A | * | 5/1977 | Ronald | 172/831 |
| 4,058,173 | A | * | 11/1977 | Carson | 172/701.3 |
| 4,574,502 | A | * | 3/1986 | Blau | 37/266 |
| 4,587,750 | A | | 5/1986 | Larson | |
| 4,794,710 | A | | 1/1989 | Häring | |
| 4,896,915 | A | | 1/1990 | Morandi et al. | |
| D310,225 | S | | 8/1990 | Eberle | |
| 5,025,577 | A | * | 6/1991 | Verseef | 37/280 |
| 5,309,653 | A | * | 5/1994 | Pease et al. | 37/266 |
| 5,544,434 | A | | 8/1996 | Calvachio, Jr. | |
| D377,653 | S | | 1/1997 | Matisz et al. | |
| D396,236 | S | | 7/1998 | Matisz et al. | |
| 5,819,444 | A | | 10/1998 | Desmarais | |
| 5,966,845 | A | | 10/1999 | DiGiacomo | |
| 6,035,560 | A | | 3/2000 | Pender | |
| 6,044,579 | A | | 4/2000 | Hadler et al. | |
| 6,112,438 | A | | 9/2000 | Weagley | |
| 6,256,909 | B1 | * | 7/2001 | Kost et al. | 37/231 |
| 6,256,910 | B1 | * | 7/2001 | Grozde | 37/266 |
| 6,928,757 | B2 | * | 8/2005 | Bloxdorf et al. | 37/231 |
| 7,334,357 | B1 | * | 2/2008 | Altheide | 37/231 |
| 2005/0076543 | A1 | * | 4/2005 | Curtis | 37/231 |
| 2005/0144814 | A1 | * | 7/2005 | Potak | 37/234 |

* cited by examiner

*Primary Examiner* — Abigail A Risic
(74) *Attorney, Agent, or Firm* — Robert C. Montgomery; Montgomery Patent & Design, LLP

(57) ABSTRACT

A snow plow blade with integrated multiple horizontal slats in lieu of one solid curved blade comprises a plurality of thin blades stacked upon one another in a staggered retreating arrangement from the bottom up. Should any blade damage occur, just the section damaged can be replaced by simply unbolting it and bolting on a new one. The slat structure allows air to flow through the blade while moving down the road and not plowing snow, enabling air to enter the radiator section of the vehicle to cool the radiator more efficiently. Finally, the slat structure is envisioned to create lift, in much the same manner as an airplane wing, thus making the blade appear lighter than its actual static weight when moving down the road and not plowing snow. This feature is envisioned to reduce wear and tear on suspension components, steering components, tires, and other similar items.

2 Claims, 6 Drawing Sheets

LOUVERED SNOW PLOW

RELATED APPLICATIONS

The present invention was first described in a notarized Official Record of Invention on Apr. 23, 2007, that is on file at the offices of Montgomery Patent and Design, LLC, the entire disclosures of which are incorporated herein by reference.

FIELD OF THE INVENTION

The present invention relates generally to a snow plow for a motor vehicle and, more particularly, to said snow plow comprising a plurality of blades in a staggered arrangement, thereby allowing replacement of an individual blade should any damage occur and air to flow through said plurality of blades enabling air to cool a radiator of the motor vehicle more efficiently.

BACKGROUND OF THE INVENTION

Snow plows are typically used to remove accumulated snow from streets and parking lots. While the effort of moving snow from one (1) part of a paved surface to another seems at first relatively straightforward, there are multiple issues to consider when evaluating the snow plow itself. First, there are fuel factors to be considered when driving around with it on the truck and not plowing snow. Secondly, the weight of the plow places additional burden on the suspension of the truck causing premature failure. Finally, the position of the plow, when not in use, forms a perfect barrier for the radiator possibly causing overheating problems. Accordingly, there exists a need for a means by which snow plows can address the disadvantages and their associated costs as addressed above. The development of the apparatus herein described fulfills this need.

There have been attempts in the past to invent refined snow plows. U.S. Pat. No. 6,112,438 issued to Weagley discloses a snow plow that appears to be foldably collapsible toward a center section. Unfortunately, this patent does not appear to disclose an upper, middle and lower blade that are positioned upon structural frame members in such a manner as to leave an opening for air to flow through the snow plow and decrease wind resistance on the plow.

U.S. Pat. No. 6,044,579 issued to Hadler et al. discloses an articulated snowplow system that appears to comprise an angled snow plow that comprises rams on either side of the center to adjust the horizontal angle of the blades. Unfortunately, this patent does not appear to disclose three (3) snow plow blades that are mounted one (1) on top of the other in a horizontal manner so as to reduce wind resistance and wear on a vehicle's suspension.

U.S. Pat. No. 6,035,560 issued to Pender discloses an air deflector with adjustable louver that is mounted on the upper surface of a snow plow. Unfortunately, this patent does not appear to disclose a louvered mechanism that is part of the snow plow, nor does it appear to disclose a series of three (3) blades that provide an opening for air passage to the radiator of a vehicle.

U.S. Pat. No. 5,966,845 issued to DiGiacomo discloses an air stream deflector mountable thereto a snow plow. Unfortunately, this patent does not appear to disclose a louvered design snow plow that provides three (3) blades that permit the passage of air through the plow.

U.S. Pat. No. 5,819,444 issued to Desmarais discloses a snow blade with tiltable lateral panels connected by hinges. Unfortunately, this patent does not appear to disclose three snow plow blades horizontally positioned upon one another which provide a gap for air to circulate through the plow to the radiator, consequently improving fuel economy and wear on the dedicated vehicle's suspension.

U.S. Pat. No. D 396,236 issued to Eberle discloses a snow plow with a blade that is angled from the vertical center of the device. Unfortunately, this design patent does not appear to be similar in appearance to the disclosed apparatus, nor does it appear to comprise an upper, middle and lower blade that are attached to mounting members and permit airflow through the snow plow.

U.S. Pat. No. D 377,653 issued to Matisz et al. discloses an angled snow plow blade structure. Unfortunately, this design patent does not appear to be similar in appearance to the disclosed apparatus, nor does it appear to possess three (3) blades that are connected by frame members that permit air flow through the plow structure.

U.S. Pat. No. 5,544,434 issued top Calvachio discloses an air flow deflector that mounts on top of a snow plow. Unfortunately, this patent does not appear to disclose a louvered mechanism that is part of the snow plow, nor does it appear to disclose a series of three (3) blades that provide an opening for air passage to the radiator of a vehicle.

U.S. Pat. No. D 310,225 issued to Matisz et al discloses an angled snow plow blade. Unfortunately, this design patent does not appear to be similar in appearance to the disclosed apparatus, nor does it appear to comprise an upper, middle and lower blade that are attached to mounting members and permit airflow through the snow plow.

U.S. Pat. No. 4,896,915 issued to Morandi discloses a wind deflector plate for snow plow that appears to comprise a deflecting plate mounted on top of a plow which directs air when moving to the rear of the plow and the radiator of a motor vehicle. Unfortunately, this patent does not appear to disclose a louvered design snow plow that comprises three (3) horizontally mounted blades positioned in such a manner as to permit air circulation through the plow.

U.S. Pat. No. 4,794,710 issued to Haring discloses a snowplow blade with spring-loaded edge flaps. Unfortunately, this patent does not appear to disclose a louvered design snow plow which permits air circulation through the plow.

U.S. Pat. No. 4,587,750 issued to Larson discloses an air scoop mounted on snow plow. Unfortunately, this patent does not appear to disclose a louvered design snow plow that comprises three horizontally mounted blades positioned in such a manner as to permit air circulation through the plow.

U.S. Pat. No. 2,085,996 issued to Phillips discloses a snow plow deflector that appears to comprise a circular deflector mounted on an upper surface of a snow plow to direct air to a radiator of a motor vehicle. Unfortunately, this patent does not appear to disclose three (3) snow plow blades horizontally positioned upon one (1) another which provide a gap for air to circulate through the plow to the radiator, consequently improving fuel economy and wear on the dedicated vehicle's suspension.

None of the prior art particularly describes a snow plow for a motor vehicle comprising a plurality of blades in a staggered arrangement, thereby allowing replacement of an individual blade should any damage occur and air to flow through said plurality of blades enabling air to cool a radiator of the motor vehicle more efficiently that the instant apparatus possesses. Accordingly, there exists a need for snow plow that operates without the disadvantages as described above.

SUMMARY OF THE INVENTION

In light of the disadvantages as previously discussed in the prior art, it is apparent that there is a need for a louvered snow plow which reduces wind resistance and provides less stress on mechanical components of the attached vehicle.

An object of the louvered snow plow is to provide a means for redirecting air into the engine compartment of a vehicle creating an additional cooling effect.

A further object of the louvered snow plow is to reduce the weight of the plow and reduce the air resistance on the surface of the plow so that wear on attached vehicle is reduced.

Another object of the louvered snow plow is to improve the fuel economy of a vehicle by the design of the plow.

Still another object of the louvered snow plow comprises blades that are louvered and coordinate with one (1) another to form an overall concave surface, similar to that of a conventional plow blade.

Still a further object of the louvered snow plow provides a coupling means to a vehicle such as pick-up truck, jeep, or similar vehicle, and could be adapted for use with larger utility trucks, or tractors.

Yet another object of the louvered snow plow comprises a means to obliquely mount to the front end of the vehicle via an existing commercially available mounting frame.

Yet a further object of the louvered design snow plow is to be retrofittable to an existing mounting frame and providing a simple means of attaching and detaching to a mounting frame.

An aspect of the louvered design snow plow comprises a lower blade, a middle blade and an upper blade.

Still another object of the louvered design snow plow provides the blades to be oriented in such a manner as to lower air resistance and increase airflow into the engine compartment.

Still a further object of the louvered design snow plow provides the lower blade, and by extension the entire apparatus, with a side-to-side motion which is provided by the pivot mounting means to the mounting frame controlled by a user via the hydraulic cylinders.

Another object of the louvered design snow plow comprises blades that are individually replaceable when worn or damaged, thereby eliminating the need to replace the entire blade as needed currently in conventional snow plows.

Another aspect of the louvered design snow plow comprises a lower blade comprising a curved surface profile in which the face is perpendicularly oriented toward an amount of snow to be plowed and that is approximately one half (½) of the overall height of the apparatus.

A further aspect of the louvered design snow plow comprises a middle blade located approximately one (1) inch above and behind the top horizontal surface of the lower scraper blade and comprises approximately one quarter (¼) of the overall height of the apparatus. The middle blade further comprises a shallow curved profile with a surface curvature less than that of the lower blade with the upper portion angled toward said lower blade approaching a horizontal orientation.

Still another aspect of the louvered design snow plow comprises an upper blade located approximately one (1) inch above and behind the top surface of the middle blade and comprises approximately one quarter (¼) of the overall height of the apparatus. The upper blade further comprises a shallow curved profile with a surface curvature equivalent to that of the lower blade with the upper portion angled toward said lower blade approaching a horizontal orientation.

Still a further aspect of the louvered design snow plow comprises a plurality of frame members that connect the blades to one another via a plurality of fasteners. The frame members comprise an overall curved profile and attaches to the back surface of the blades.

A further aspect of the louvered design snow plow comprises an upper notch and a lower notch. The upper notch supports the upper blade and provides a spacing means with the middle blade and the middle notch supports said middle blade and provides a spacing means with the lower blade. The angle of the top surface of the notches is equivalent to the angle of the face of the corresponding blades.

Yet another aspect of the louvered design snow plow comprises a scraper edge comprising an upper lip portion which attaches to the bottom front edge of the lower blade via a plurality of fasteners and that provides the snow scraping means for the apparatus.

Still another aspect of the louvered design snow plow comprises a mounting bracket located in the lower center of the back surface of the lower blade and that is pivotally attached to the mounting frame by a mounting bracket pin through a mounting bracket aperture.

Yet still another aspect of the louvered design snow plow comprises a hydraulic bracket located on either side of the mounting bracket and that is pivotally attached to the hydraulic cylinders of the mounting frame via a hydraulic bracket pin through a hydraulic bracket aperture.

A further aspect of the louvered design snow plow comprises two (2) spring brackets located on the back surface of the lower blade and that provide an attachment means for the springs to the apparatus. The spring provides a resistance means when the apparatus strikes an unseen obstacle in the snow the entire apparatus will bend forward and pass over the obstacle.

Another aspect of the louvered snow plow comprises a quadrant attached to the back surface of the lower blade that is removably attached to a common "C"-channel type segment or similar support of the mounting frame and that provides a means for supporting the apparatus in an upright position and pivoting said apparatus when plowing snow.

An aspect of the louvered snow plow, in an alternate embodiment, comprises substantially similar materials and functions as the preferred louvered snow plow with the particular enhancement of the inclusion of the mounting frame as one (1) unit.

Another aspect of the louvered design snow plow, in an alternate embodiment, comprises a lower lift frame comprising an "A"-frame member which attaches to the quadrant and the mounting bracket. The lower lift frame comprising two plow horns, two (2) stand hooks, and at least two (2) lock pin apertures. The stand hook engages a round member on the mounting bracket and provides added security and stability to the frame.

A further aspect of the louvered design snow plow, in an alternate embodiment, comprises a hydraulic lift that attaches to the upper lift frame and provides the means of vertical lift to the louvered snow plow via a lift ram. The hydraulic lift drives the lift ram thus raising or lowering the lift arm.

Still another aspect of the louvered design snow plow, in an alternate embodiment, comprises a mounting bracket that attaches to the front underside of a frame of the vehicle via a plurality of mounting fasteners. A receiving bracket is located subjacent to the mounting bracket and comprises a hollow channel which is suitable to receive the plow horn.

Still a further aspect of the louvered design snow plow, in an alternate embodiment comprises a mounting frame further comprising two (2) angling rams which attach to the rear surface of the louvered snow plow at the hydraulic brackets. The angling ram is a hydraulic shock absorber or as a hydraulically actuated member which may be used to manipulate the plowing angle of the louvered snow plow.

Yet a further aspect of the louvered design snow plow, in an alternate embodiment comprises a means of electrically controlling the up-down motion through the hydraulic lift and the side-to-side motion through the angling ram located within the cab portion of the vehicle.

A method of installing and utilizing the apparatus may be achieved by performing the following steps: removing an existing snow plow blade from an existing mounting frame or installing a mounting frame to a vehicle; retrieving a louvered snow plow; attaching the apparatus to the existing mounting frame; pivotally attaching the mounting bracket to the mounting frame; inserting a mounting bracket pin through the mounting bracket aperture; removably attaching the distal end of the quadrant to an existing channel connection on the mounting frame; pivotally attaching each hydraulic bracket to a hydraulic cylinder of the mounting frame; inserting a hydraulic bracket pin through the hydraulic bracket aperture; removably attaching each spring to the mounting frame; positioning the apparatus as desired for use via the hydraulic cylinders on the mounting frame; plowing snow as normal; and benefiting from the utilization of the present apparatus.

A method of installing and utilizing the alternate louvered snow plow may be achieved by performing steps substantially similar to those described for the preferred apparatus with the particular additions of the following steps: preparing the vehicle for the attachment of the mounting frame; attaching the mounting bracket to the front underside of the vehicle via the mounting fasteners; inserting the plow horns into the receiving bracket; engaging the stand hooks; inserting the lock pin through the aligned lock pin apertures; plowing snow as normal; and, benefiting from the utilization of the present alternate louvered snow plow.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
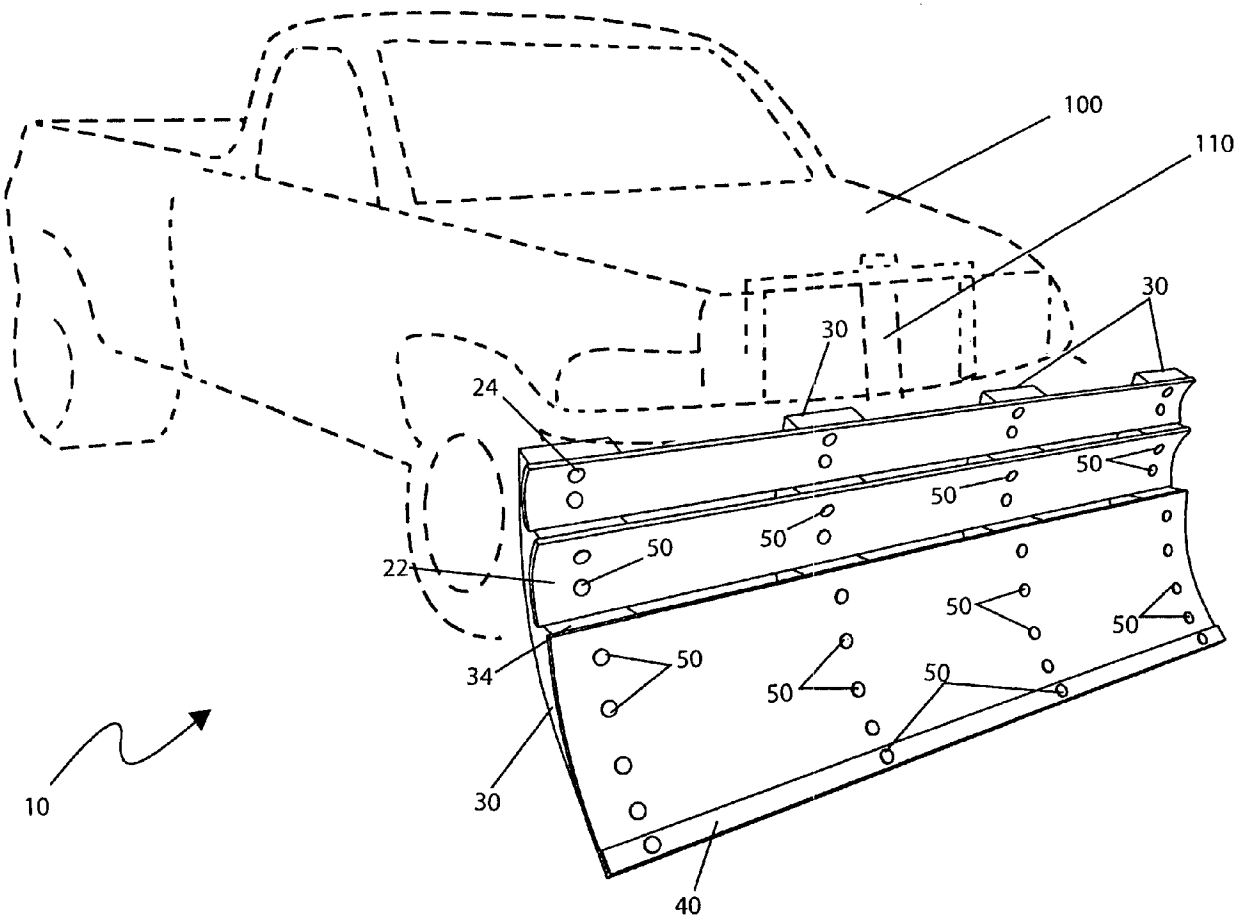
FIG. 1 is a front environmental view of a louvered snow plow 10, according to a preferred embodiment of the present invention.

10 louvered snow plow
15 alternate louvered snow plow
20 lower blade
22 middle blade
24 upper blade
30 frame member
32 upper notch
34 middle notch
40 scraper edge
50 fastener
52 fastener aperture
61 mounting bracket
62 mounting bracket aperture
63 hydraulic bracket
64 hydraulic bracket aperture
65 hydraulic bracket pin
66 spring bracket
67 eyelet
68 spring
69 mounting bracket pin
70 quadrant
100 vehicle
110 mounting frame
111 lower lift frame
112 upper lift frame
113 plow horn
114 stand hook
115 "A"-frame
117 angling ram
118 hydraulic unit
119 lift ram
120 lift arm
125 receiving bracket
126 frame mount
127 mounting fastener
128 lock pin aperture
129 lock pin
130 pin
131 frame fastener

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a louvered snow plow (herein described as the "apparatus") 10, which provides a means for a snow plow generally comprising a lower blade 20, a middle blade 22, and an upper blade 24 blade in lieu of one solid curved blade. The blades 20, 22, 24 are louvered and coordinate with one another to form an overall concave surface, similar to that of a conventional plow blade. This multi-blade louvered orientation is envisioned to provide a means for redirecting air thereinto the engine compartment of a vehicle 100 thereby creating an additional cooling effect, creating an aerodynamic lift similar to that seen in an airfoil thereby effectively reducing the weight of the apparatus 10, and reducing the air resistance thereon the surface of said apparatus 10 thereby reducing the wear on the suspension and increasing the fuel economy of a vehicle 100.

Figure 2:
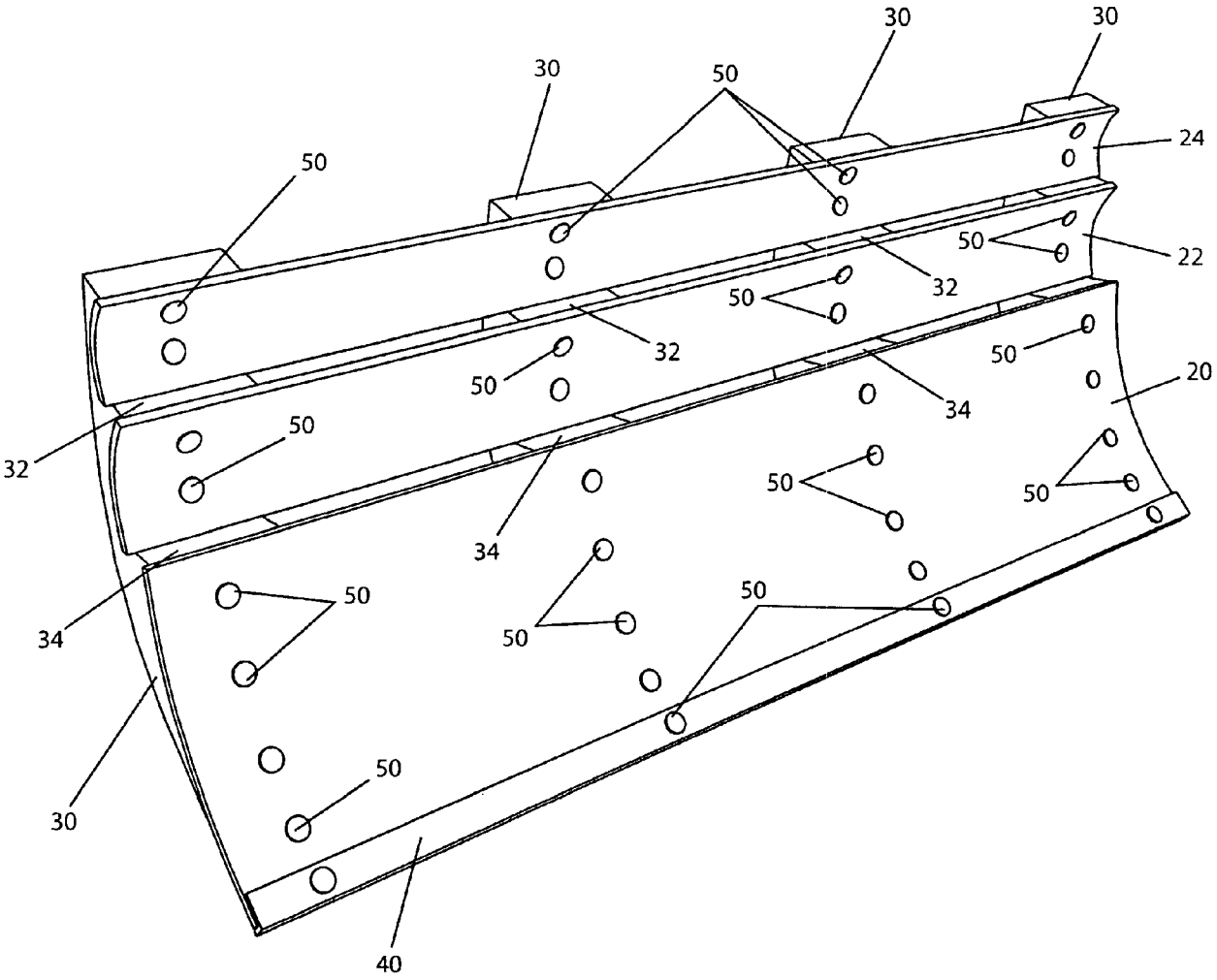
FIG. 2 is a front perspective view of a louvered snow plow 10, according to a preferred embodiment of the present invention.

Referring now to FIGS. 1 and 2, front views of the apparatus 10, according to the preferred embodiment of the present invention, is disclosed. The apparatus 10 is envisioned as being coupled thereto a vehicle 100 such as pick-up truck, jeep, or similar vehicle 100, but it is not limited for use with light weight vehicles 100 and it is understood that said apparatus could be adapted for use with larger utility trucks, tractors, or the like. The apparatus 10 is obliquely mounted thereto the front end of the vehicle 100 via an existing commercially available mounting frame 110. The mounting frame 110 provides the means of attaching the apparatus 10 thereto a vehicle 100 and controlling the vertical and side-to-side position of said apparatus 10 and is envisioned to comprise expected features such as, a hydraulic lift, hydraulic cylinders, hydraulic fluid hoses, mounting brackets, support and restraining members, lighting fixtures, and the like. Although illustrated here as retrofittable to an existing mounting frame 110 it is understood that the apparatus 10 may be introduced with a companion vehicle mounting frame 110 similar to other commercially available mounting frames 110 and as such should not be interpreted as a limit of said present apparatus 10. The apparatus 10 is envisioned as being moved and oriented therein a vertical and a horizontal position through the use of a hydraulic system (not shown) integrated therein the mounting frame 110. The apparatus 10 is envisioned as an improved retrofit thereto an existing snowplow and provides a simple means of attaching thereto and detaching therefrom the mounting frame 110. Although it is understood that the apparatus 10 may be introduced comprising an accompanying plow frame 110 and hydraulic system as one (1) integrated unit.

The blades 20, 22, 24 are envisioned as being between three thirty-seconds (3/32) and one fourth (1/4) inch thick and preferably made of a painted or powdercoated steel, a durable plastic, or the like and fabricated through common metal or plastic processing techniques; each providing equal benefit to a user of the apparatus 10. The lower blade 20 comprises a curved surface profile in which the face is perpendicularly oriented toward an amount of snow to be plowed and is approximately one half (1/2) of the overall height of the apparatus 10. The middle blade 22 is located approximately one (1) inch above and behind the top horizontal surface of the lower scraper blade 20 and comprises approximately one quarter (1/4) of the overall height of the apparatus 10. The middle blade 22 further comprises a shallow curved profile with a surface curvature less than that of the lower blade 20 with the upper portion angled toward said lower blade 20 approaching a horizontal orientation. The upper blade 24 is located approximately one (1) inch above and behind the top surface of the middle blade 22 and comprises approximately one quarter (1/4) of the overall height of the apparatus 10. The upper blade 24 further comprises a shallow curved profile with a surface curvature equivalent to that of the lower blade 20 with the upper portion angled toward said lower blade 20 approaching a horizontal orientation. The orientation of the blades 20, 22, 24 provide for a lowered air resistance and increased airflow into the engine compartment. The blades 20, 22, 24 are connected to one another via a plurality of frame members 30. The blades 20, 22, 24 attach thereto the frame members 30 via a plurality of fasteners 50 which are preferably common bolts and nuts, screws, or the like. Although the apparatus 10 is illustrated with the component parts attached by fasteners 50 it is understood that the blades 20, 22, 24 may be attached thereto the frame members by other attachment means such as welding or the like. The apparatus 10 further comprises a scraper edge 40 preferably made of steel or resilient rubber approximately three-eighths (3/8) to one half (1/2) inch thick. The scraper edge 40 comprises an upper lip portion which attaches to the bottom front edge of the lower blade 20 via a plurality of fasteners 50 and is envisioned to provide the snow scraping means for the apparatus 10.

Figure 3:
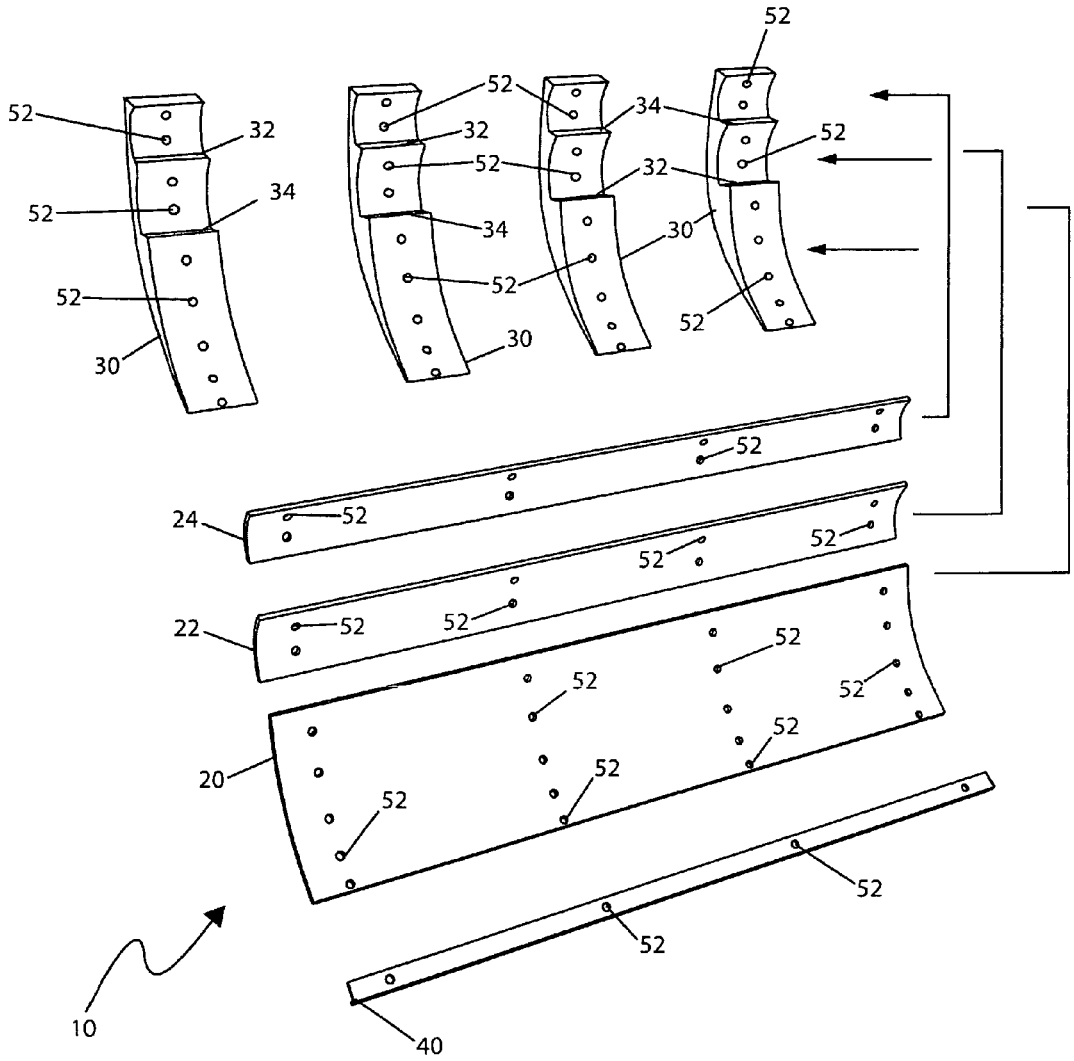
FIG. 3 is an exploded front perspective view of a louvered snow plow 10, according to a preferred embodiment of the present invention.

Referring now to FIG. 3, an exploded front view of the apparatus 10, according to the preferred embodiment of the present invention, is disclosed. The apparatus 10 is depicted illustrating the manner in which the blades 20, 22, 24 are oriented thereon the frame members 30. The frame members 30 comprise an overall curved profile which provides the curvature of the snow plow 10 and further comprises segmented curved profiles which provide the angle of the individual blades 20, 22, 24. Each frame member 30 attaches to the back surface of the blades 20, 22, 24 and comprise an upper notch 32 and a middle notch 34 which provide a support and spacing means thereto said louvered blades 20, 22, 24. The frame member 30 comprises a plurality of fastener apertures 52 located vertically along a center axis of said frame member 30. Each blade 20, 22, 24 comprises a plurality of fastener apertures 52 which coincide with corresponding fastener apertures 52 therein the frame members 30 thereby accommodating a fastener 50 therethrough and enabling said blades 20, 22, 24 to attach thereto said frame members 30. The scraper edge 40 comprises a plurality of fastener apertures 52 located on the upper lip portion of said scraper edge 40 and provide the attachment meant thereto the lower blade 20 via the fasteners 50.

Figure 4:
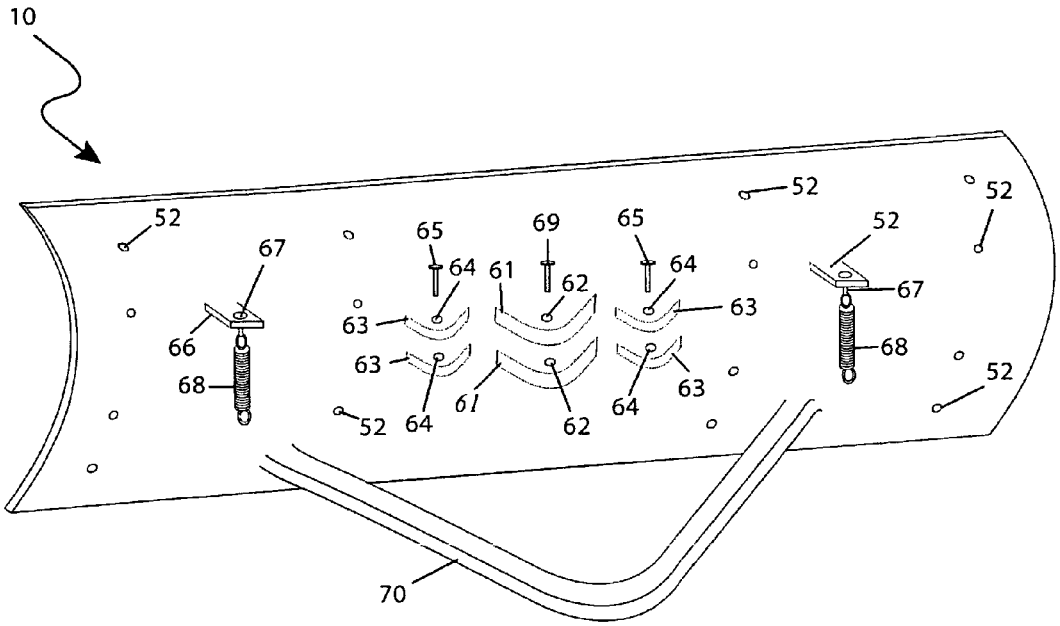
FIG. 4 is a rear perspective view of a lower blade 20, according to a preferred embodiment of the present invention.

Referring now to FIG. 4, a rear perspective view of the lower blade 20, according to a preferred embodiment of the present invention, is disclosed. The apparatus 10 comprises a mounting bracket 61, two (2) hydraulic brackets 63, two (2) spring brackets 66 and a quadrant 70 which provide the means for the apparatus 10 to attach thereto the mounting frame 110. The mounting bracket 61 is located in the lower center of the back surface of the lower blade 20 and is pivotally attached thereto the mounting frame 110 via a mounting bracket pin 69 therethrough a mounting bracket aperture 62. A hydraulic bracket 63 is located on either side of the mounting bracket 61 and is pivotally attached thereto the hydraulic cylinders of the mounting frame 110 via a hydraulic bracket pin 65 therethrough a hydraulic bracket aperture 64. The lower blade 20 and by extension the entire apparatus 10 is envisioned to have a side-to-side motion which is provided by the pivot mounting means thereto the mounting frame 110 and is controlled by a user via the hydraulic cylinders. Two (2) spring brackets 66 are located toward distal ends of the back surface of the lower blade 20 and provide an attachment means for the springs 68 thereto the apparatus 10. The spring 68 is attached thereto the spring bracket 66 on one (1) end via an eyelet 67 secured therein said bracket 66 and is attached thereto the mounting frame 110 on the other end. The spring 68 provides a resistance means when the apparatus 10 strikes an unseen obstacle in the snow the entire apparatus 10 will bend forward and pass over the obstacle. The apparatus 10 may also be introduced with differing resistance means such as but not limited to securing hooks which removably attach thereto an underside surface of the "A"-frame or the like. Although illustrated having two (2) springs 68 it is understood the apparatus 10 may be introduced comprising any plurality of springs 68 depending on the model of the apparatus 10 and as such should not be viewed as a limiting factor of the invention 10. The quadrant 70 is attached thereto the back surface of the lower blade 20 via welding or through fasteners and removably attaches thereto a common "C"-channel type segment or similar support of the mounting frame 110 and provides a means for supporting the apparatus 10 in an upright position and pivoting said apparatus 10 when plowing snow. It is understood that the "A"-frame may be introduced in various dimensions depending on the mounting frame 110 to which attached thereto.

Figure 5:
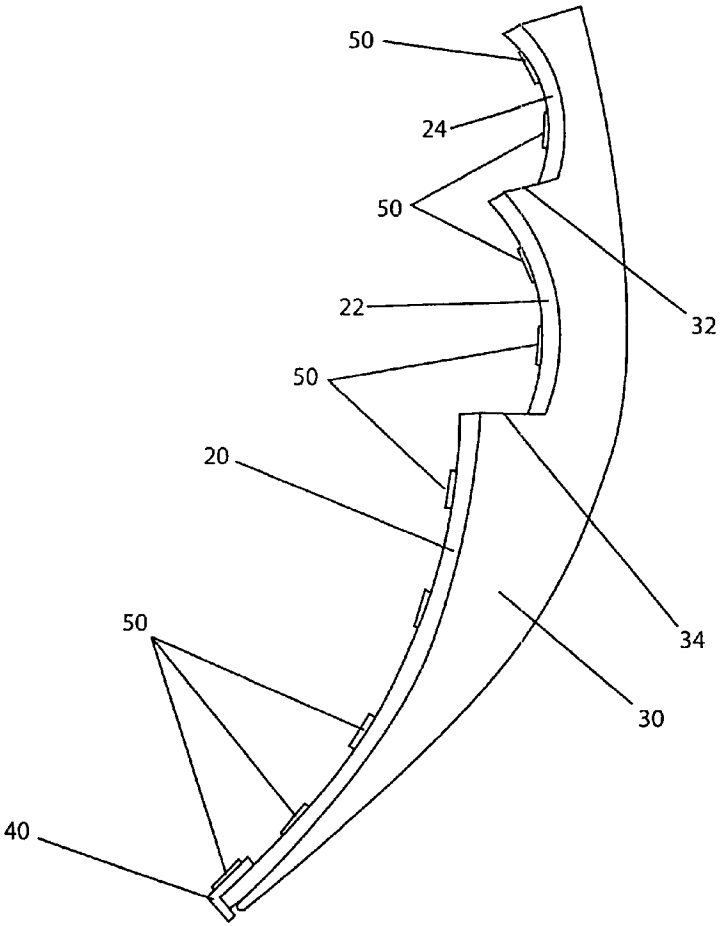
FIG. 5 is a side profile view of a louvered snow plow 10, according to a preferred embodiment of the present invention.

Referring now to FIG. 5, a side profile view of the apparatus 10, according to a preferred embodiment of the present invention, is disclosed. The blades 20, 22, 24 are envisioned as being individually replaceable when worn or damaged, thereby eliminating the need to replace the entire blade as needed currently in conventional snow plows. The upper notch 32 supports the upper blade 24 and provides a spacing means therewith the middle blade 22 and the middle notch 34 supports said middle blade 22 and provides a spacing means therewith the lower blade 20. The angle of the top surface of the notches 32, 34 is equivalent to the angle of the face of the corresponding blades 22, 24. The lower blade 20 is envisioned as having a generally vertical orientation where an upper edge is in vertical alignment therewith a lower edge of said lower blade 20.

Figure 6:
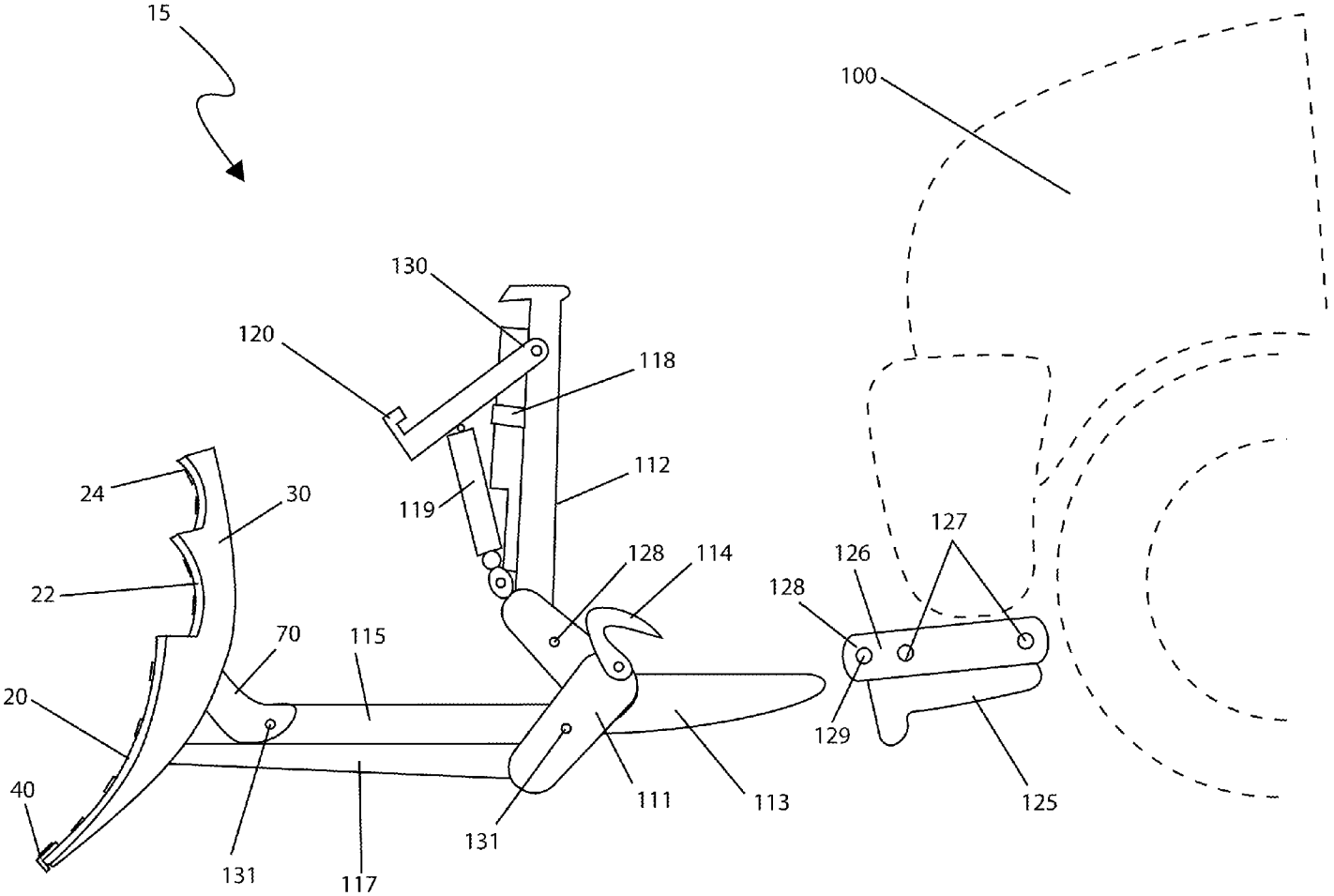
FIG. 6 is a side view of an alternate louvered snow plow 15, according to a preferred embodiment of the present invention.

Referring now to FIG. 6, a side view of an alternate louvered snow plow 15, according to an alternate embodiment of the present invention, is disclosed. The alternate louvered snow plow 15 comprises substantially similar materials and functions as the preferred louvered snow plow 10 with the particular enhancement of the inclusion of the mounting frame 110 as one (1) unit. The mounting frame 110 attaches thereto the louvered snow plow 10 in an expected manner and generally comprises expected features similar to other similar commercially available vehicle mounted frames such as, but not limited to, a lower lift frame 111, an upper lift frame 112, a hydraulic lift 118, and "A"-frame support member 115, a vehicle mounting bracket 126, and the like. The mounting bracket is preferably made of a durable material such as metal and be manufactured and attached through common techniques such as welding, hardware frame fasteners 131, and the like. The lower lift frame 111 comprises the main lower support member to the mounting frame 110 and further comprises two plow horns 113, two (2) stand hooks 114, and at least two (2) lock pin apertures 128. The mounting bracket 126 attaches thereto the front underside of a frame of the vehicle 100 via a plurality of mounting fasteners 127 which are envisioned as durable mechanical fasteners such as bolts or the like. A receiving bracket 125 is located subjacent thereto the mounting bracket 126 and comprises a hollow channel which is suitable to receive the plow horn 113 which is inserted therein. The mounting frame 110 is secured thereto the mounting bracket 126 once the plow horn 113 is inserted therein the receiving bracket via a lock pin 129 and the stand hook 114. The lock pin 129 is inserted therethrough the aligned lock pin apertures 128 located thereon the lower lift frame 111 and the mounting bracket 126. The stand hook 114 engages a round member thereon the mounting bracket 126 and provides added security and stability thereto the frame 110. The upper lift fame 112 provides the main vertical support member thereto the mounting frame. The hydraulic lift 118 attaches thereto the upper lift frame 112 and provides the means of vertical lift thereto the louvered snow plow 10 via a lift ram 119. The lift ram 119 attaches thereto a lift arm 120 which is rotatably attached thereto the upper lift frame 112 via a pin 130. The hydraulic lift 118 drives the lift ram 119 thus raising or lowering the lift arm 120. The lower lift frame 111 comprises an "A"-frame member 115 which attaches thereto the quadrant 70 and the mounting bracket 61 thereon the louvered snow plow 10 via the mounting bracket pin 69 and frame fasteners 131. The mounting frame 110 further comprises two (2) angling rams 117 which attach thereto the rear surface of the louvered snow plow 10 thereat the hydraulic brackets 63 via the hydraulic bracket pins 65. The angling ram 117 is envisioned as being a hydraulic shock absorber or as a hydraulically actuated member which may be used to manipulate the plowing angle of the louvered snow plow 10 as such should not be viewed as a limiting factor of the alternate embodiment of the present invention 10. A means of electrically controlling the up-down motion therethrough the hydraulic lift 118 and the side-to-side motion therethrough the angling ram 117 is envisioned to be located therewithin the cab portion of the vehicle 100 and comprise features common to a controlled plow lift such as wiring, a control box, and the like (not shown). It is understood that portions of the mounting frame 110 may introduced a various configurations in order to accommodate various vehicle 100 designs and mounting requirements without affecting the scope and adding equal benefit thereto a user.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1-4.

The method of installing and utilizing the apparatus 10 may be achieved by performing the following steps: removing an existing snow plow blade from an existing mounting frame 110 or installing a mounting frame 110 thereto a vehicle 100; retrieving a louvered snow plow 10; attaching the apparatus 10 thereto the existing mounting frame; pivotally attaching the mounting bracket 61 thereto the mounting frame 110; inserting a mounting bracket pin 69 therethrough the mounting bracket aperture 62; removably attaching the distal end of the quadrant 70 thereto an existing channel connection thereon the mounting frame 110; pivotally attaching each hydraulic bracket 63 thereto a hydraulic cylinder of the mounting frame 110; inserting a hydraulic bracket pin 65 therethrough the hydraulic bracket aperture 64; removably attaching each spring 68 thereto the mounting frame 110; positioning the apparatus 10 as desired for use via the hydraulic cylinders thereon the mounting frame 110; plowing snow as normal; and benefiting from the utilization of the present apparatus 10.

The method of installing and utilizing the alternate louvered snow plow 15 may be achieved by performing steps substantially similar to those described for the preferred apparatus 10 with the particular additions of the following steps: preparing the vehicle 100 for the attachment of the mounting frame 110; attaching the mounting bracket 126 thereto the front underside of the vehicle 100 via the mounting fasteners 127; inserting the plow horns 113 thereinto the receiving bracket 125; engaging the stand hooks 114; inserting the lock pin 129 therethrough the aligned lock pin apertures 128; plowing snow as normal; and, benefiting from the utilization of the present alternate louvered snow plow 15.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A method for using a snow plow apparatus, said method comprising the steps of:

providing said apparatus, comprising:

a plurality of unitary frame members each comprising an upper portion, a middle portion, a lower portion, an upper notch separating said upper portion and said middle portion, and a middle notch separating said middle portion and said lower portion;

a lower blade removably connected thereto said lower portion of each of said plurality of frame members;

a middle blade removably connected thereto said middle portion of each of said plurality of frame members; and, an upper blade removably connected thereto said upper portion of each of said plurality of frame members;

wherein said upper notch and said middle notch provide a support means and a spacing means thereto said lower blade, said middle blade, and said upper blade;

wherein said upper notch and said middle notch provide a fixed angled configuration of the individual blades;

wherein said lower blade, said middle blade, said upper blade are louvered and form a concave surface;

wherein said apparatus provides a means for redirecting a flow of air thereinto an engine compartment of a vehicle, thereby creating an additional cooling effect;

wherein said apparatus creates an aerodynamic lift, thereby reducing a weight of said apparatus; and, wherein said apparatus reduces air resistance thereon a front surface of said apparatus, thereby reducing wear on a suspension of a vehicle and increasing fuel economy of said vehicle;

removing an existing snow plow blade from an existing mounting frame or installing a mounting frame thereto a vehicle;

attaching said apparatus thereto said existing mounting frame;

pivotally attaching a mounting bracket thereto said existing mounting frame;

inserting a mounting bracket pin therethrough a mounting bracket aperture;

removably attaching a distal end of a quadrant thereto an existing channel connection thereon said existing mounting frame;

pivotally attaching each hydraulic bracket thereto a hydraulic cylinder of said existing mounting frame;

inserting a hydraulic bracket pin therethrough a hydraulic bracket aperture;

removably attaching each spring thereto said existing mounting frame;

positioning said apparatus as desired for use via said hydraulic cylinders thereon said existing mounting frame; and, commencing a plowing action.

2. The method of claim 1, comprising the additional step of attaching said apparatus thereto said vehicle using an integral mounting frame.

* * * * *